US010590578B2

(12) United States Patent
Schwarzberger et al.

(10) Patent No.: US 10,590,578 B2
(45) Date of Patent: Mar. 17, 2020

(54) EMBROIDERY QUILTING APPARATUS, METHOD, AND COMPUTER-READABLE MEDIUM

(71) Applicant: ABM International, Inc., The Woodlands, TX (US)

(72) Inventors: Neal A. Schwarzberger, The Woodlands, TX (US); William E. Schnaufer, Rochester, NY (US)

(73) Assignee: ABM International, Inc., The Woodlands, TX (US)

( * ) Notice: Subject to any disclaimer, the term of this patent is extended or adjusted under 35 U.S.C. 154(b) by 0 days.

(21) Appl. No.: 15/948,458

(22) Filed: Apr. 9, 2018

(65) Prior Publication Data

US 2019/0119840 A1 Apr. 25, 2019

Related U.S. Application Data

(63) Continuation-in-part of application No. 15/790,746, filed on Oct. 23, 2017.

(51) Int. Cl.

| | |
|---|---|
| ***D05B 19/10*** | (2006.01) |
| ***D05C 3/02*** | (2006.01) |
| ***D05C 13/00*** | (2006.01) |
| ***D05B 19/08*** | (2006.01) |
| ***D05C 7/00*** | (2006.01) |
| ***D05B 69/30*** | (2006.01) |
| ***D05C 5/02*** | (2006.01) |

(52) U.S. Cl.

CPC ..... *D05B 19/10* (2013.01); *D05B 19/08* (2013.01); *D05B 69/30* (2013.01); *D05C 3/02* (2013.01); *D05C 5/02* (2013.01); *D05C 7/00* (2013.01); *D05C 13/00* (2013.01); *D05D 2205/18* (2013.01)

(58) Field of Classification Search

CPC ..... D05B 19/00; D05B 19/02; D05B 19/04; D05B 19/08; D05B 19/10; D05C 5/00; D05C 5/02

USPC ..... 700/138

See application file for complete search history.

(56) References Cited

U.S. PATENT DOCUMENTS 5,791,271 A * 8/1998 Futamura ..... D05B 19/08 112/102.5

5,839,380 A * 11/1998 Muto ..... D05B 19/06 112/102.5

(Continued)

*Primary Examiner* — Nathan E Durham

(74) *Attorney, Agent, or Firm* — Timothy W. Menasco, Esq.; Harter Secrest & Emery LLP

(57) ABSTRACT

Presented are a method, apparatus, and computer-readable medium for stitching. The method includes examining, by an examiner, an embroidery design, wherein the examiner is operably coupled to a controller and a sewing head, and wherein the controller comprises a memory having a capacity, and wherein the controller is operable to cause the sewing head to stitch a work piece. The method further includes determining, by the examiner, a needle drop location of each stitch of the embroidery design, and dividing, by the examiner, the examined embroidery design into a plurality of separate sections. The method still further includes transmitting the plurality of separate sections at a plurality of different times to the controller such that the controller the plurality of separate sections do not exceed the capacity of the memory at any one of the plurality of different times.

8 Claims, 5 Drawing Sheets

(56) References Cited

U.S. PATENT DOCUMENTS

| | | | | |
|---|---|---|---|---|
| 6,397,120 | B1 * | 5/2002 | Goldman | D05B 19/08 112/102.5 |
| 2002/0007228 | A1 * | 1/2002 | Goldman | D05B 19/08 700/138 |
| 2002/0104468 | A1 * | 8/2002 | Myers | D05B 11/00 112/117 |
| 2005/0171628 | A1 * | 8/2005 | Suzuki | D05B 19/08 700/138 |
| 2006/0021559 | A1 * | 2/2006 | Kaiya | D05B 19/10 112/475.18 |
| 2009/0151612 | A1 * | 6/2009 | Bentley | D05B 11/00 112/470.04 |
| 2010/0228383 | A1 * | 9/2010 | Taguchi | D05B 19/10 700/138 |
| 2010/0234979 | A1 * | 9/2010 | Katano | D05B 19/10 700/138 |
| 2011/0295410 | A1 * | 12/2011 | Yamada | D05B 19/08 700/138 |
| 2012/0111249 | A1 * | 5/2012 | Sekine | D05B 19/10 112/102.5 |
| 2014/0060407 | A1 * | 3/2014 | Abe | D05C 5/06 112/102.5 |
| 2014/0094952 | A1 * | 4/2014 | Goldman | F21V 9/00 700/138 |
| 2015/0128835 | A1 * | 5/2015 | Naka | D05C 5/02 112/102.5 |

* cited by examiner

EMBROIDERY QUILTING APPARATUS, METHOD, AND COMPUTER-READABLE MEDIUM

BACKGROUND OF THE INVENTION

Field of the Invention

The present disclosure relates to a method, apparatus, and computer-readable medium for stitching. The present disclosure relates more particularly to a method, apparatus, and computer-readable medium for embroidery stitching.

Description of Related Art

Embroidery is the craft of decorating fabric or other materials with needle and thread or yarn. Embroidery can also include the use of metal strips, beads, and sequins. Embroidery can be used on caps, hats, coats, blankets, dresses, and shirts. Embroidery can be used with a variety of different threads and/or yarn color.

Embroidery thread can be manufactured with cotton and yarns as well as in wool and linen. Ribbon embroidery includes the use of narrow ribbon in silk. Surface embroidery techniques such as chain stitch and couching are among the most cost effective for high-end yarns. Canvas work techniques require more threading material, but usually provide a more robust final product.

An embroidery hoop or frame can be used in both canvas work and surface embroidery. This stretches the material to ensure that even stitching is employed throughout the embroidered design. Embroidery can include the use of similar stitching patterns to form a design, or the use of many different stitching patterns to form a design.

BRIEF SUMMARY OF THE INVENTION

In view of the foregoing, it is an object of the present disclosure to provide a method, apparatus, and computer-readable medium for quilting.

A first exemplary embodiment of the present disclosure provides a method for stitching. The method includes examining, by an apparatus, a stitching design, and determining, by the apparatus, a needle drop location of each stitch of the stitching design. The method further includes stitching, by the apparatus, the stitching design into a work piece based on the determined needle drop location, wherein the stitching comprises continuously moving a sewing head of the apparatus relative to the work piece.

A second exemplary embodiment of the present disclosure provides an apparatus for stitching. The apparatus includes a sewing head including a reciprocating needle, a memory including computer program instructions, and a processor, wherein the sewing head including the reciprocating needle, the memory, and the processor are configured to cause the apparatus to at least examine a stitching design. The apparatus is further configured to determine a needle drop location of each stitch of the stitching design, and stitch the stitching design into a work piece based on the determined needle drop location, wherein the stitching comprises continuously moving a sewing head of the apparatus relative to the work piece.

A third exemplary embodiment of the present disclosure provides a non-transitory computer-readable medium tangibly comprising computer program instructions which when executed on a processor of an apparatus causes the apparatus to at least examine a stitching design, and determine a needle drop location of each stitch of the stitching design. The non-transitory computer-readable medium including computer program instructions when executed on the processor further cause the apparatus to stitch the stitching design into a work piece based on the determined needle drop location, wherein the stitching comprises continuously moving a sewing head of the apparatus relative to the work piece.

A fourth exemplary embodiment of the present disclosure provides an apparatus for stitching. The apparatus includes a quilting machine having a work piece retention area and a sewing head with a reciprocating needle, the sewing head configured to form a plurality of stitches and moveable relative to the workpiece retention area, and a controller for controlling movement of the sewing head relative to the work piece retention area, the controller operable to examine a stitching design to determine a needle drop location of each stitch of the stitching design and a length of each stitch of the stitching of the design. The apparatus further includes an encoder for regulating a position of the reciprocating needle within its reciprocating cycle, the encoder operably connected to the controller, and an X-Y encoder positionable adjacent to a portion of the work piece retention area, the X-Y encoder operably connected to the controller.

A fifth exemplary embodiment of the present disclosure provides a method of stitching. The method includes examining, by an apparatus, an embroidery design, and determining, by the apparatus, a needle drop location of each stitch of the embroidery design. The method further includes dividing, by the apparatus, the examined embroidery design into a plurality of separate sections, selecting an order for stitching the plurality of separate sections, and based on the selecting, stitching, by the apparatus, the plurality of separate sections into a work piece based on the determined needle drop location, wherein the stitching comprises moving a sewing head of the apparatus relative to the work piece.

A sixth exemplary embodiment of the present disclosure provides an apparatus for stitching, the apparatus including a sewing head including a reciprocating needle, a memory including computer program instructions, and a processor, wherein the sewing head including the reciprocating needle, the memory, and the processor are configured to cause the apparatus to at least examine an embroidery design, and determine a needle drop location of each stitch of the embroidery design. The the sewing head including the reciprocating needle, the memory, and the processor are configured to further cause the apparatus divide the examined embroidery design into a plurality of separate sections, select an order for stitching the plurality of separate sections, and based on the selecting, stitch the stitching design into a work piece based on the determined needle drop location, wherein the stitching comprises moving a sewing head of the apparatus relative to the work piece.

A seventh exemplary embodiment of the present disclosure provides a method of stitching. The method includes examining, by an examiner, an embroidery design, wherein the examiner is operably coupled to a controller and a sewing head, and wherein the controller comprises a memory having a capacity, and wherein the controller is operable to cause the sewing head to stitch a work piece. The method further includes determining, by the examiner, a needle drop location of each stitch of the embroidery design, and dividing, by the examiner, the examined embroidery design into a plurality of separate sections. The method still further includes transmitting the plurality of separate sections at a plurality of different times to the controller such that the controller the plurality of separate sections do not exceed the capacity of the memory at any one of the plurality of different times, and in response to the controller, stitching, by the sewing head, the plurality of separate sections into the work piece based on the determined needle drop location.

An eighth exemplary embodiment of the present disclosure provides an apparatus for stitching. The apparatus includes an examiner operable to examiner an embroidery design to determine a needle drop location of each stitch of the embroidery design, the examiner is further operable to divide the examined embroidery design into a plurality of separate sections, the examiner operable to maintain the embroidery design and the plurality of separate sections in an examiner memory, and a sewing head including a reciprocating needle, the sewing head operable to stitch a work piece. The apparatus further includes a controller having a memory capacity and operably coupled to the examiner and the sewing head, the controller operable to cause the sewing head to stitch the work piece, the controller operable to receive the plurality of separate sections from the examiner at a plurality of different times such that the plurality of separate sections do not exceed the memory capacity at any one of the plurality of different times, wherein the sewing head is operable to stitch, in response to the controller, the plurality of separate sections into the work piece based on the determined needle drop location.

The following will describe embodiments of the present disclosure, but it should be appreciated that the present disclosure is not limited to the described embodiments and various modifications of the invention are possible without departing from the basic principle. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Embodiments of the present disclosure provide a method, apparatus, and computer-readable medium that allow a quilting machine to examine an embroidery design to determine the needle drop locations of the stitches, and then allows a user to automatically embroider the examined design on the workpiece with the quilting machine or a long-arm quilting machine.

Figure 1:
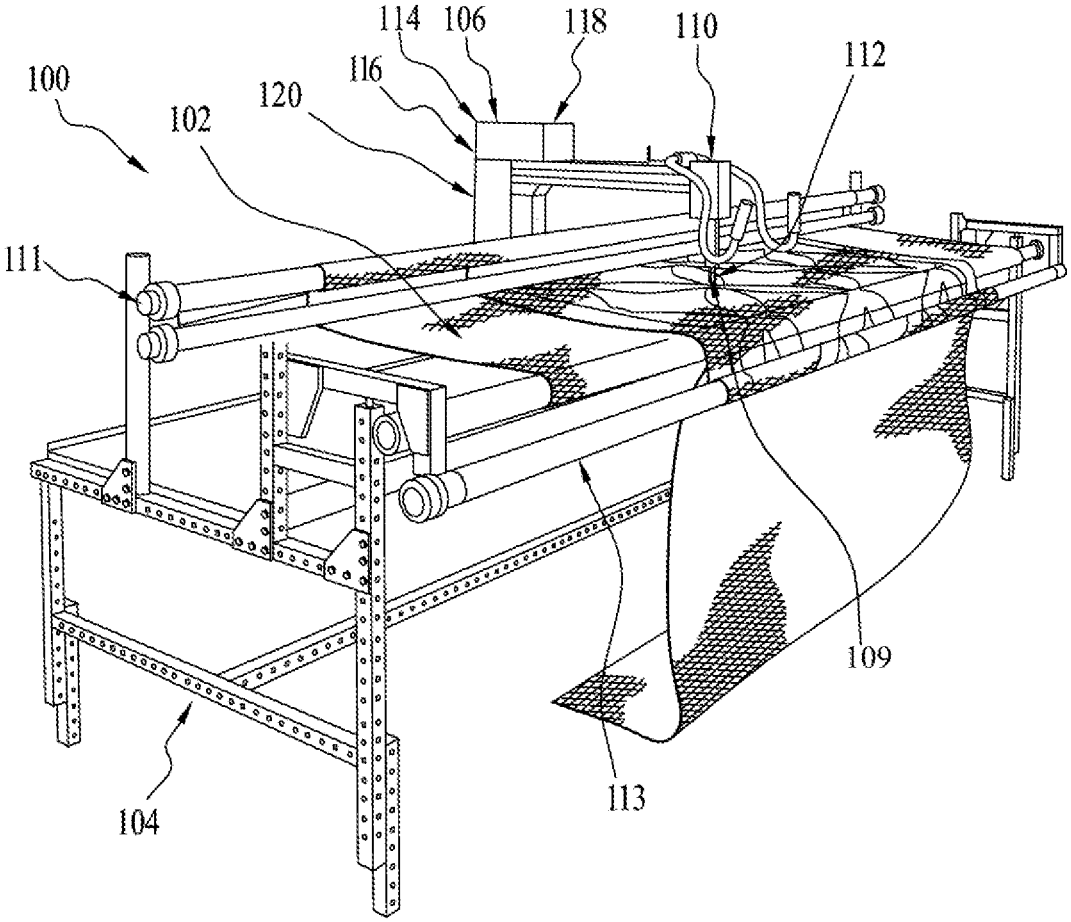
FIG. 1 is a perspective view of a configuration of a device suitable for use in practicing exemplary embodiments of this disclosure.

Referring to FIG. 1, shown is an exemplary quilting machine 100. It should be noted that embodiments of the present disclosure are not limited to the particular configuration of quilting machine 100, but may include many different types of configurations provided they operate as described below.

The term quilting machine 100 encompasses any device for stitching or embroidery of a workpiece 102 (or textile). The term quilting machine 100 includes embroidery machines, quilting machines, and long arm quilting machines for stitching together multiple layers, such as a filler layer between a top and a bottom textile layer.

The term workpiece 102 (or textile) includes any article of manufacture or fabric made by weaving, felting, knitting, crocheting, compressing natural or synthetic fibers. In one exemplary embodiment, workpiece 102 is a quilt. It is common to refer to sections of a quilt as a quilt block. A quilt block is a small segment of a quilt top. The combination of a number of quilt blocks together makes a quilt. The blocks can be the same, or different from each other. Quilt blocks can be pieced or appliqued or may represent a given portion of the quilt.

Quilting machine 100 includes a main frame 104, a sewing machine 106, support frame 108 for supporting or retaining a workpiece, a sewing head 110, a reciprocating needle 112, a motor 114, a controller 116, an encoder 118, and an examiner 120.

Main frame 104 is coupled to support frame 108. Main frame 104 includes a combination of legs, struts, and support bars to maintain a position of support frame 104 and quilting machine 100 above a floor or opposing surface. Support frame 108 provides a workpiece retention area that retains workpiece 102 or a portion of workpiece 102 relative to main frame 104 and relative to sewing machine 106. Support frame 104 can include a supply roll assembly 113 and take up roll assembly 111 for maintaining and selectively providing portions of workpiece 102 that are not presently maintained within the workpiece retention area.

Support frame 104 can include any variety of configurations, wherein the frame includes struts or supports for engaging components described herein. Support frame 104 is operable to support and maintain all of the elements of quilting machine 100 including main frame 108, sewing machine 106, and workpiece 102. The frame can be made of any of a variety of materials such as metals, plastics, composites, wood or any combination thereof.

Sewing machine 106 includes sewing head 110. Sewing head 110 includes a portion above the plane of the work piece retention area and a second portion below the plane of the workpiece retention area, thereby providing for passage of a portion of reciprocating needle 112 through workpiece 102 and selectively engaging the passage of a length of thread through workpiece 102. Exemplary embodiments of sewing head 110 are configured to operably move and stitch through the plane of the workpiece retention area through the use of a plurality of wheels, gears, rails slides, or combinations thereof.

Controller 116 is operably connected to the sewing head 110, encoder 118, and examiner 120. The controller 116 can include a display and input, such as a touch screen, keyboard, keypad, and/or mouse. The controller 116 can be physically connected to the main frame 104 or the sewing machine 106. Alternatively, the controller 116 can be a stand-alone device, which communicates with the sewing machine 106, the encoder 118, and the examiner 120 through a wired or wireless connection.

Encoder 118 includes mechanical sensors for sensing movement of sewing machine 106 relative to support frame 108. Encoder 118 operably tracks and communicates a direction and velocity of sewing head 110 over the workpiece retention area. Encoder 118 is operably connected to controller 116 to communicate with controller 116 the data necessary to determine the direction, location, and speed of the sewing head 110 relative to workpiece 102. Encoder 118 is also operably connected to controller 116 to communicate with controller 116 the data necessary to determine the drop location of reciprocating needle 112. For instance encoder 118 may be operable to determine the z-axis position of reciprocating needle 112, the direction of movement of reciprocating needle 112 (i.e., up movement or down movement), and/or the speed of the up and down movement of reciprocating needle 112.

In one exemplary embodiment, encoder 118 includes at least a first encoder 118 that operably tracks and communicates a direction and velocity of movement of the sewing head 110 in the x-axis direction, a second encoder 118 that operably tracks and communicates a direction and velocity of movement of the sewing head 110 in the y-axis direction, and a third encoder 118 that operably tracks and communicates a drop location, direction, and velocity of movement of reciprocating needle 112. It should be appreciated that embodiments of encoder 118 may be located on or in a body of sewing head 110, and/or the rails, gears, wheels, or a combination thereof on which sewing head 110 moves throughout the workpiece retention area.

Motor 118 is operably connected to and communicates with controller 116 and/or encoder 118. Motor 118 controls the up and down speed of reciprocating needle 112 and movement of sewing head 110 relative to workpiece retention area. In some embodiments, motor 118 includes one or more motors each operable to move a different element or multiple elements of sewing machine 106. For instance, motor 118 may include one motor operable to control the reciprocating needle 112 and a second motor operable to control an X and Y axis movement of sewing head 110 over the workpiece retention area. In another embodiment, motor 118 includes one motor operable to control reciprocating needle 112, a second motor operable to control an X-axis movement of sewing head 110 over the workpiece retention area, and a third motor operable to control an Y-axis movement of sewing head 110 over the workpiece retention area.

An encoder can be operably coupled to at least one of the motor 118 or the reciprocating needle 112 to monitor the position of the needle relative to the workpiece. The encoder is further connected to the controller and thus provides for an elevation, or Z-axis control of the needle.

Motor 116 can be operably coupled to any combination of rails, pulleys, gears, wheels, and belts that operably couple sewing head 110 to motor 116 such that motor 116 can move sewing head 110 over the work piece retention area and reciprocating needle 112.

Examiner 120 is operably coupled to controller 116. Examiner 120 includes at least one memory and at least one processor and is operable to receive and store one or a plurality of embroidery designs. In another embodiment, examiner 120 is integral with controller 116. In yet another embodiment, controller 116 is operable to store and/or receive one or a plurality of embroidery designs, which can be accessed by examiner 120. An exemplary embroidery design includes either (i) computer program instructions for a generic embroidery machine that can instruct the generic embroidery machine to create an embroidered stitching design in a workpiece, and (ii) a picture of an embroidered stitch design in a textile (collectively, an embroidery design).

Examiner 120 is operable to examine and analyze an embroidery design to determine stitching instructions for sewing machine 106 such that sewing machine 106 can create or stitch the embroidery design into workpiece 102. For instance, Examiner 120 can examine an embroidery design that includes machine readable instructions for movement of a workpiece 102 and reciprocating speed of reciprocating needle 112. Examiner 120 is operable to determine from the machine readable instructions movement of sewing head 110 over a stationary workpiece 102 and needle drop locations of reciprocating needle 112 such that quilting machine 100 can create the embroidery design. The determined stitching instructions includes stitch length and needle drop location information for each stitch required by the embroidery design and movement information or instructions for movement of sewing head 110 and reciprocating needle 112 relative to workpiece 102. Examiner 120 can then provide instructions to controller 116 with which encoder 118 and motor 118, upon a user initiation, enables sewing machine 106 to automatically move and stitch with reciprocating needle 112 the analyzed embroidery design in workpiece 102.

That is, examiner 120 electronically analyzes an electronic representation of a pattern, or instructions for creating such pattern and determines a number of stitches in the pattern. The number of stitches in the pattern is a function of at least the reciprocating speed of reciprocating needle 112 and speed of movement of sewing head 110 relative to workpiece 102. The examiner 120 then calculates a stitch length for each of the stitches in the pattern. Associated with each stitch and stitch length, the examiner 120 determines a drop position for the reciprocating needle 112, a needle drop $N_d$. While each stitch length is defined by a pair of needle drops $N_d$ it is understood that one needle drop may define one end of two stitches. Thus, the examiner 120 can control the stitch length by setting positions on each of the X,Y,Z axis. Examiner 120 is further operable to add or subtract stitches to an embroidery design based on the area for which a particular embroidery design is meant to be used to stitch and the area in which a user desires to stitch an embroidery design. For example, a particular embroidery design may include 100,000 stitches to be stitched in a 1 square foot area of a work piece. Examiner 120 is operable to add stitches to the embroidery design such that it retains the same stitch density (e.g., stitches per square inch) for a 3 square foot area of a work piece. Likewise, examiner 120 is operable subtract stitches or decrease stitch length should a user desire to stitch the embroidery design in a 0.5 square foot area.

A predetermined stitch length (such as by virtue of associated needle drops) and position, by virtue of the needle drop along the X,Y axes is calculated by the examiner 120 by generating an array of stitch lengths and positions. In one configuration, the examiner 120 can be set with a maximum dimension of the stitch length and can then determine the number of stitches, the associated stitch length and needle drops for a given pattern.

In one configuration, a standard embroidery code is provided or input into the examiner 120. The standard code is converted to a vector file and then to a numerical control programming language or G-code (such as RS-274). The present programming then determines a stitch length and/or needle drop locations.

In one embodiment, examiner 120 is operable to examine and analyze portions of an embroidery design at different time intervals rather than examining and analyzing the entire embroidery design at once. For example, in this embodiment, examiner 120 can examine ⅛ of an embroidery design that is machine readable instructions to determine movement and stitching of sewing head 110 over a stationary workpiece 102 and needle drop locations of reciprocating needle 112 such that quilting machine 100 can create ⅛ of the embroidery design. Examiner 120 is operable then to examine and analyze the embroidery design in ⅛ increments until the entire embroidery design has been examined, analyzed and stitched. This embodiment enables examiner 120 and controller 116 to examiner, analyze and stitch embroidery designs that include large amounts of data. For instance, the amount of data may either be too large for the at least one processor of examiner 120 and too large for at least one memory of examiner 120 to perform optimally, or may slow down quilting machine 102 to a speed that is undesirable for users. It should be appreciated that example above referred to portions of ⅛ increments, however, embodiments include dividing embroidery design into any number of fractions that allow quilting machine 102 with reciprocating needle 112 to operate at least at 250-300 stitches/minute.

In another embodiment, examiner 120 is operable to examine and analyze an embroidery design such that examiner 120 can split, divide or chunk an embroidery design into one or more, or a plurality of sections such that sewing head 110 and controller 116 can selectively stitch each one or more section of the embroidery design separately as desired. In this embodiment, the one or more, or plurality of sections in combination represent the entirety of the embroidery design. This embodiment includes the ability for quilting machine 102 to provide the user with the option to select which of the one or more sections of the embroidery design to stitch at a time and in which order. This embodiment further prevents the size (i.e., size or capacity of memory needed to maintain the embroidery design) of the embroidery design to act as a limiting factor for controller 116 to be able to process and stitch an embroidery design. Rather, examiner 120 is operable to maintain the plurality of sections such that each one of the plurality of sections is sent to the controller 116 individually or as groups during the stitching process such that the controller 116 is operable to maintain the plurality of sections it receives from the examiner 120 at a given time. In this regard, embodiments of examiner 120 with controller 116 are operable to automatically (or in response to user input) have individual embroidery sections or groups of embroidery sections sent from examiner 120 to controller 116 (based on the size of the memory needed to maintain the embroidery sections and the memory capacity of controller 116) such that controller 116 is operable to maintain the embroidery sections and to have sewing head 110 stitch the received embroidery sections. Thus, examiner 120 is operable to transmit and controller 116 is operable to receive separate sections of an embroidery design at a plurality of different times such that the received separate sections at a given time internal does not exceed the memory capacity of controller 116.

For instance, examiner 120 can be operable to maintain an embroidery design that includes a plurality of sections totaling over 500,000 stitches. However, controller 116 may only be able to maintain embroidery designs having 150,000 stitches at a given time. Embodiments of this disclosure provide that examiner 120 is operable to send to controller 116 the plurality of sections of the embroidery design to controller 116 in groups having less than 150,000 stitches such that controller 116 is able to seamless stitch the entire embroidery design. Thus, embodiments provide that examiner 120 is operable to send controller 116 sections of an examined and divided embroidery design such that the sections are within the capacity (i.e., memory capacity) of controller 116 to maintain such sections and instruct sewing head 110 to stitch the received sections in a work piece 102.

For example, stitching a work piece can cause shrinking or movement of the portions of the work piece 102 that are stitched. Additionally, sections of a work piece 102 can move during the embroidery process, especially for the case that the embroidery design is large or covers a large area. For instance, if the embroidery design is a picture of a large tree with a trunk and many leaves, examiner 120 is operable to divide the tree into separate sections that allow the sewing head 110 and/or the user to separately embroider each section of the tree embroidery design. For instance, the trunk, and each of the leaves can be separately embroidered at different times rather than continuously embroidered in a predetermined order. Additionally, this embodiment allows the sewing head 110 to pause the stitching between completion of stitching one section and beginning stitching another section so as to allow the quilting machine 100 (through automated or manual rotation of supply roll assembly 113 and take up roll assembly 11) to move work piece 102 to compensate for movement or shrinking during stitching. In this regard, quilting machine 100 does not require the use of a hoop or removable hoop to maintain a tightness on the embroidered section of the work piece 102. Embodiments provide that the quilting machine 100 and/or the user is able adjust the location of work piece 102 relative the sewing head 110 in order to compensate for any movement or shrinkage of work piece 102 in response to the section or sections of the embroidery design that have been embroidered into the work piece 102.

Examiner 120 is also operable to assign a reference character (e.g., a number or a letter) to identify to each section of the tree embroidery design such that sewing head 110 can embroider each section associated with each number or letter identifier separately. The reference characters along with each section can be displayed by a display. In one embodiment, the displayed reference characters with corresponding sections allow for user input to determine the order in which each section is to be stitched by sewing head 110. This embodiment further allows the user to select through controller 116, as desired, the order in which each section of the split, divided, or chunked embroidery design is stitched into the work piece 102.

Embodiments of examiner 120 further provide that examiner 120 is operable to determine from an embroidery design (whether machine readable instructions of an embroidery design or an electronic representation of an embroidery pattern) (1) movement instructions for sewing head 110, and (2) needle drop locations such that quilting machine 100 is operable to create the embroidery design. The embroidery design examined may include machine readable instructions for movement of a work piece relative to a sewing head along with instructions for increasing or decreasing reciprocating needle as the work piece moves during stitching. Examiner 120 is operable to determine movement instructions for sewing head 110 relative to a stationary work piece 102 such that reciprocating needle 112 speed does not change, but remains constant. In this configuration, examiner 120 is operable to determine movement instructions for sewing head 110, which instructs sewing head 110 to move and stop at incremental times such that movement occurs when the reciprocating needle 112 is outside the work piece, and such that movement does not occur when the reciprocating needle 112 is within the work piece. In another embodiment, examiner 120 determines movement instructions for sewing head 110 such that movement occurs while reciprocating needle 112 is on the way up and the way down during its reciprocating cycle. Movement of sewing head 110 does not occur while reciprocating needle 112 is in the down position. It should be appreciated that embodiments include the examiner 120 operable to determine movement instructions for sewing head 110 relative to a stationary work piece 102 such that reciprocating needle 112 speed does change during the stitching process to accommodate varying stitch lengths between needle drop locations.

Embodiments of examiner 120 provide that it is operable to allow quilting machine 100 to embroider examined and analyzed embroidery designs that are within the work piece retention 109 or that area larger than the work piece retention area 109. For example, if the embroidery design is larger than the work piece retention area 109, examiner 120 is operable to provide instructions to sewing head 110, controller 116, reciprocating needle 112, encoder 118, and motor 118 to stitch within the work piece retention area 109. Once the embroidered design within the work piece retention area 109 is complete, quilting machine 100 with examiner 120 is operable to either (1) provide the user with instructions for providing new unembroidered portions of the work piece 102 to embroider by rotating supply roll assembly 113 and take up roll assembly 111, or (2) automatically cause the supply roll assembly 113 and take up roll assembly 111 to rotate to provide new portions of the work piece 102 to embroider. In the second embodiment above, quilting machine 100 includes one or more motors controlled by controller 116 operable to rotate supply roll assembly 113 and take up roll assembly 111. In the embodiment described herein, quilting machine 100 is operable to embroider a design without the need of a retention hoop required by all embroidery machines. Embodiments further provide that quilting machine 100 is operable to embroider a design that is as large as the work piece itself and larger than the work piece retention area 109.

Figure 2:
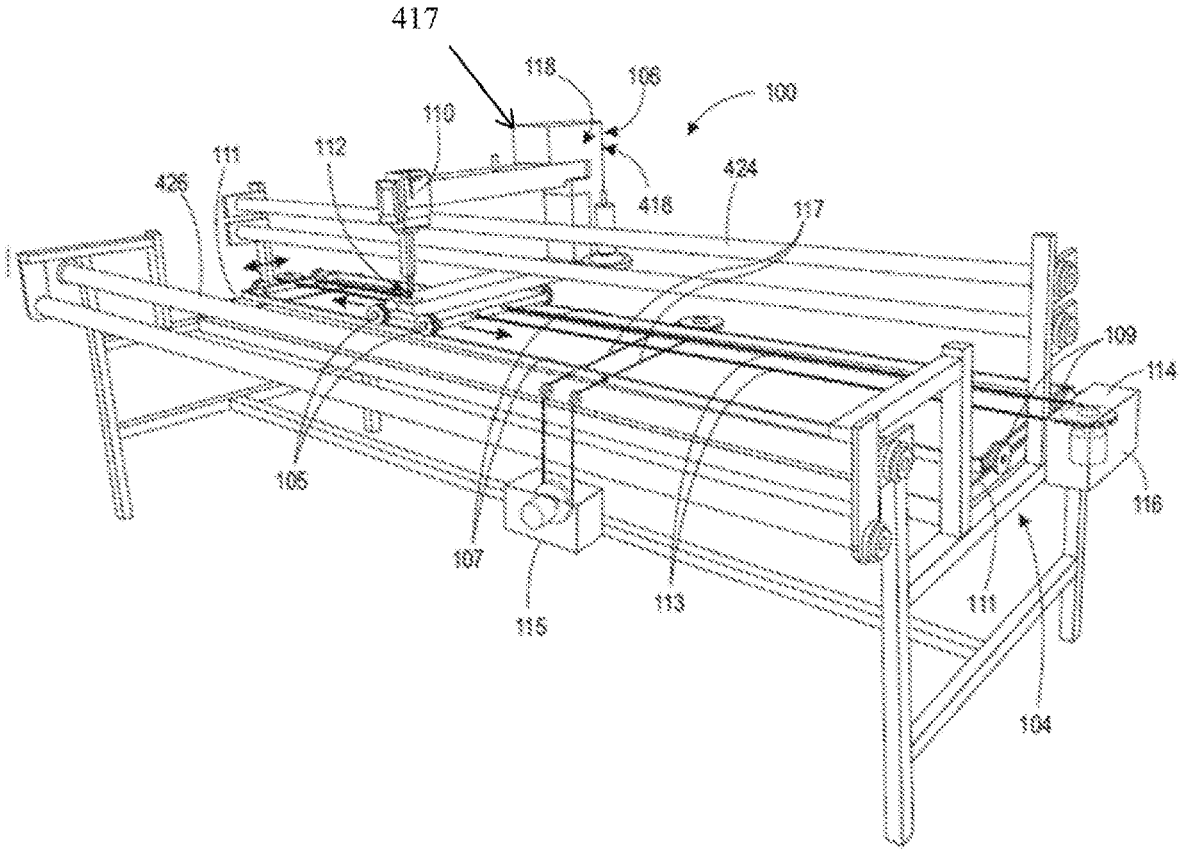
FIG. 2 is a perspective view of another configuration of a device suitable for use in practicing exemplary embodiments of this disclosure.

Reference is now made to FIG. 2, which presents a perspective view of another configuration of a device suitable for use in practicing exemplary embodiments of this disclosure. Shown in FIG. 2 is quilting machine 100 suitable for use in exemplary embodiments of the present disclosure. Shown in FIG. 2 is quilting machine 100 with a main frame 104, sewing machine 106, sewing head 110, reciprocating needle 112, encoder 117, motor 115, motor 116, controller 118, and examiner 418.

As can be seen in FIG. 2, sewing machine 106 is moveably attached to main frame 104 via wheels 105 and rails 107 that allow sewing machine 106 and sewing head 110 to move over the workpiece retention area in a x-axis direction. Sewing machine 106 and sewing head 110 are also able to move over the workpiece retention area in an y-axis direction through wheels 109 and rails 111. Sewing head 110 is thus able to move throughout the workpiece retention area in both an x-axis and y-axis manner by the use of wheel 105, 109, and rails 107, 111.

Sewing machine 106 is operably coupled to motor 116 through belts 113. Belts 113 with motor 116 are able to move or aid in movement of sewing machine 106 in the x-axis direction. Sewing machine 106 and sewing head 110 is also moveably coupled to motor 115 through belts 117. Belts 117 with motor 115 are able to move or aid in movement of sewing machine 106 in the y-axis direction. Motor 115 and motor 116 are operably coupled to controller 118 such that controller 118 is operable to control movement of sewing head 110.

In practice, examiner 418 can examine an embroidery design (or stitching design) to determine the needle drop location of the reciprocating needle 112 to determine a stitch length of each stitch. It is further contemplated that each stitch will have a length defined by sequential needle drops. Then controller 118 is operable to automatically move with motor 115 and motor 116 sewing head 110 and reciprocating needle 112 over the workpiece retention area to stitch the embroidery design into the workpiece.

Figure 3:
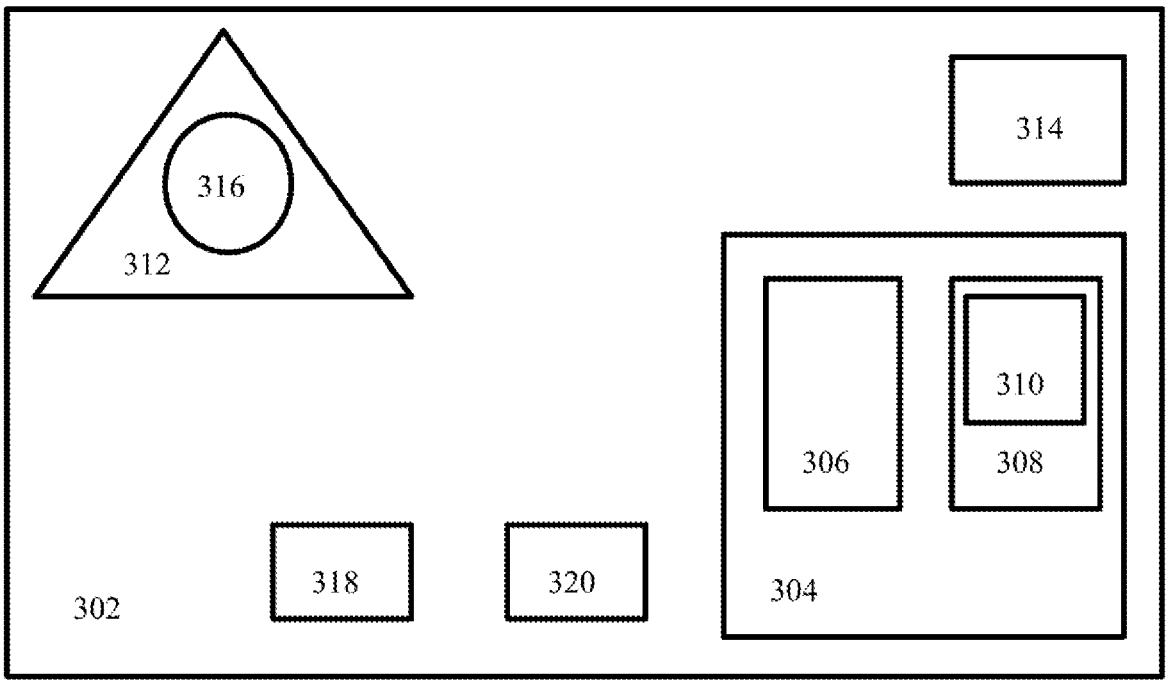
FIG. 3 is a simplified block diagram of a device suitable for use in practicing exemplary embodiments of this disclosure.

Reference is now made to FIG. 3, which illustrates a simplified block diagram of various elements of a quilting machine suitable for use in practicing the exemplary embodiments of this disclosure. Shown in FIG. 3 is quilting machine 302 configured for stitching and embroidering a workpiece. Embodiments of quilting machine 302 can include a quilting machine and a longarm quilting machine.

Quilting machine 302 includes processing means such as controller 304, which includes at least one data processor 306, storing means such as a computer-readable memory 308 storing a computer program 310 including computer program instructions. Controller 304, data processor 306, and computer-readable memory 308 with computer program 310 provide a mechanism to (i) examine an embroidery design, and (ii) automatically embroider a workpiece with the examined embroidery design. Embodiments of controller 304 include a motion controller for operably controlling movement of quilting machine 302.

Quilting machine 302 includes a sewing head 312 for stitching a workpiece and a motor 314 operably connected to the controller 304 and the sewing head 314 such as by belts, pulleys, gear racks, friction drives, ball screws, linear motors, and/or chains. Controller 304 is able to control the output of motor 314. Motor 314 is able to control the movement of sewing head 312 by activating belts or motorized wheels/rollers.

Sewing head 312 also includes a reciprocating needle 316 operably connected to controller 304 and motor 314. The movement of sewing head 312 and cycle frequency of reciprocating needle 316 is controlled by motor 314 and in turn determined by controller 304. In another embodiment, motor 314 only controls the cycle frequency of reciprocating needle 316 and a second motor 315 (not shown) is operably coupled to sewing head 312 to move sewing head 312 over a workpiece retention area.

Quilting machine 302 also includes examiner 312 for examining an embroidery design. Examiner 318 is operable to examine an embroidery design (including embroidery machine instructions and/or a photo or image of an embroidered design) and is also operably coupled to controller 304, data processor 306 and computer-readable memory 308 such that examiner 318 is able to transmit stitching data (including movement instructions of sewing head and reciprocating instructions of reciprocating needle 316) to controller 304 to instruct motor 314 to make sewing head 312 with reciprocating needle 316 embroider the examined embroidery design in a workpiece. Embodiments of examiner 318 are operable to examine stored embroidery designs located in computer-readable memory 308. Embodiments of examiner 318 are able to receive embroidery designs from the internet or other devices (e.g., computers, laptops, mobile devices, tablets, storage devices, and USB sticks) through wired or wireless connections.

The quilting machine 302 includes encoder 320 to encode a sensed movement information of sewing head 314 and reciprocating needle 316 relative to a workpiece. Encoder 320 is operably connected to sewing head 314 and reciprocating needle 316 as well as controller 304, data processor 306, and motor 314. Encoder 320 may include a first encoder, a second encoder, and a third encoder, wherein the first encoder encodes the sensed movement information of sewing head 314 in an x-axis direction, the second encoder encodes the sensed movement information of sewing head 314 in an y-axis direction, and the third encoder encodes the sensed movement information of reciprocating needle 316.

Quilting machine 302 further includes an operational on/off switch 318 for selectively operating controller 304, motor 314, and examiner 312. In some embodiments, on/off switch 318 is a physical switch located on quilting machine 302 that can be operated by hand.

The at least one computer program 310 in quilting machine 302 in exemplary embodiments is a set of program instructions that, when executed by the associated processor 308, enable quilting machine 302 to operate in accordance with exemplary embodiments of this disclosure. In these regards, the exemplary embodiments of this disclosure may be implemented at least in part by computer software stored in computer-readable memory 308, which is executable by processor 306. Devices implementing these aspects of the disclosure need not be the entire device as depicted in FIG. 3, but may be one or more components of same such as the above described tangibly stored software, hardware, and processor.

Figure 4:
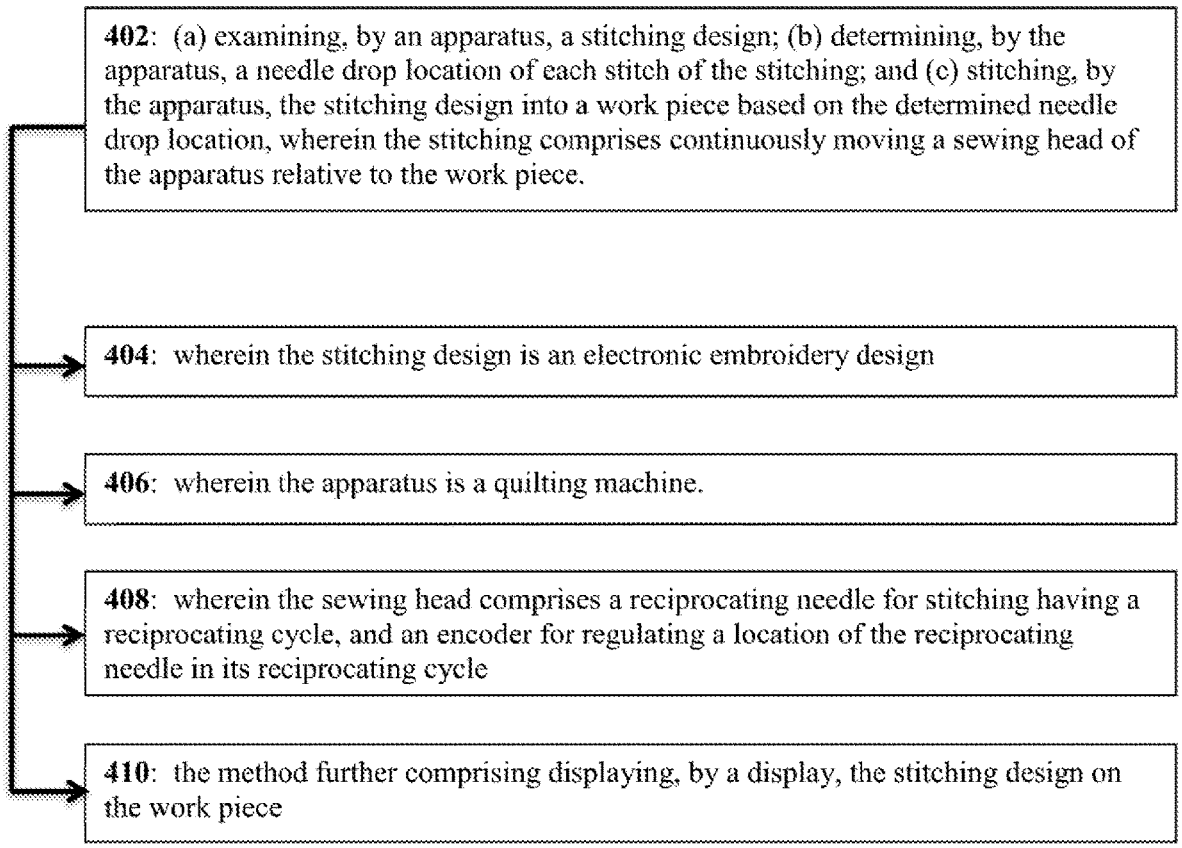
FIG. 4 is a logic flow diagram in accordance with a method, apparatus, and computer-readable medium for performing exemplary embodiments of this disclosure.

FIG. 4 presents a summary of the above teachings for examining an embroidery design and embroidering a workpiece. Block 402 presents (a) examining, by an apparatus, a stitching design; (b) determining, by the apparatus, a needle drop location of each stitch of the stitching design; and (c) stitching, by the apparatus, the stitching design into a work piece based on the determined needle drop location, wherein the stitching comprises continuously moving a sewing head of the apparatus relative to the work piece. Then block 404 specifies wherein the stitching design is an electronic embroidery design.

Some of the non-limiting implementations detailed above are also summarized at FIG. 4 following block 404. Block 406 relates to wherein the apparatus is a quilting machine. Block 408 further specifies wherein the sewing head comprises a reciprocating needle for stitching having a reciprocating cycle, and an encoder for regulating a location of the reciprocating needle in its reciprocating cycle. Then block 410 relates to the method further comprising displaying, by a display, the stitching design on the work piece.

Thus, exemplary embodiments of the present disclosure provide an apparatus that can automatically examine a stitching design (or an embroidery design) and then stitch examined design into a workpiece.

Figure 5:
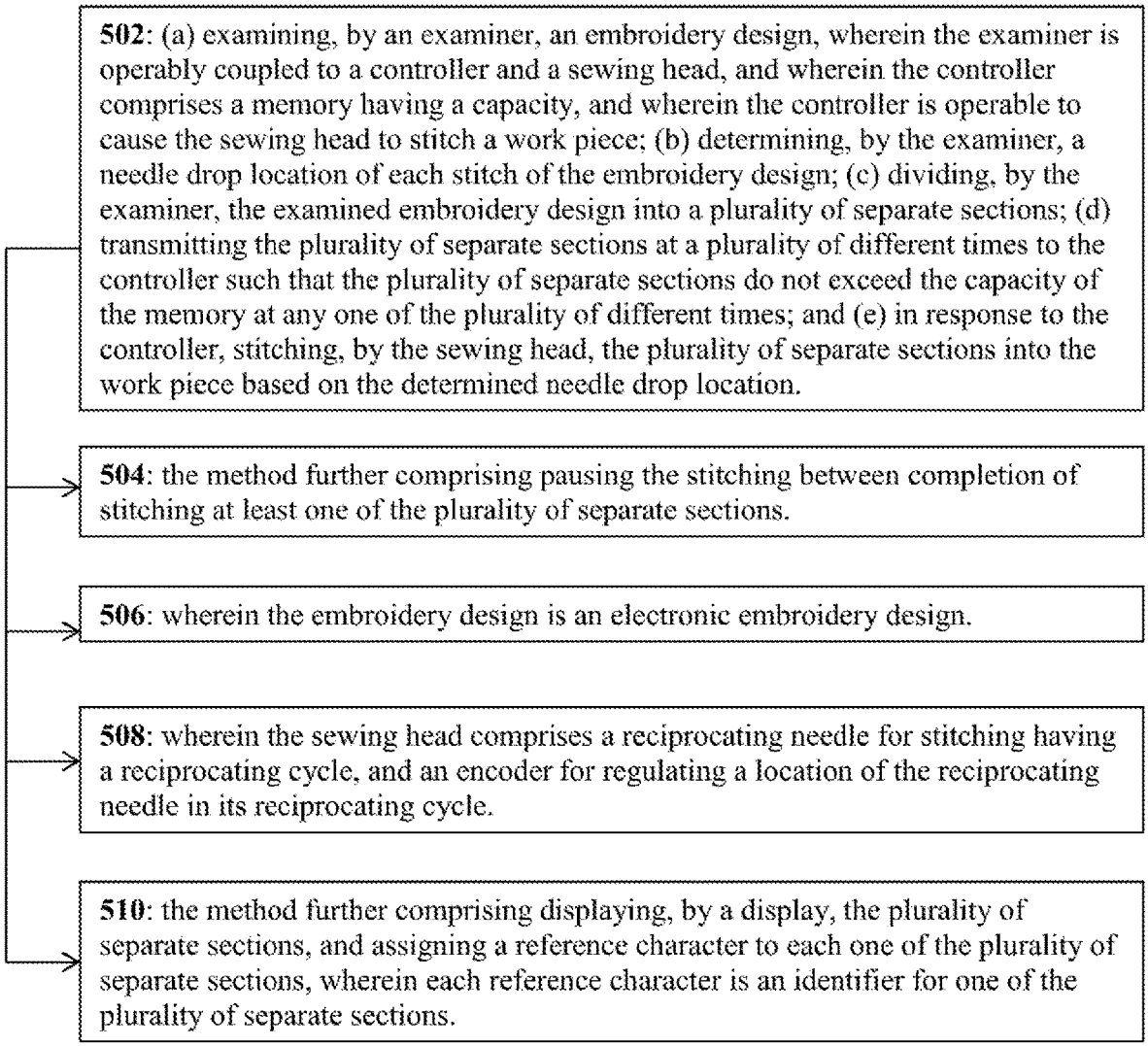
FIG. 5 is a logic flow diagram in accordance with a method, apparatus, and computer-readable medium for performing exemplary embodiments of this disclosure.

Referring to FIG. 5, shown is an exemplary logic flow diagram in accordance with exemplary embodiments of the present disclosure. Block 502 states (a) examining, by an examiner, an embroidery design, wherein the examiner is operably coupled to a controller and a sewing head, and wherein the controller comprises a memory having a capacity, and wherein the controller is operable to cause the sewing head to stitch a work piece; (b) determining, by the examiner, a needle drop location of each stitch of the embroidery design; (c) dividing, by the examiner, the examined embroidery design into a plurality of separate sections; (d) transmitting the plurality of separate sections at a plurality of different times to the controller such that the plurality of separate sections do not exceed the capacity of the memory at any one of the plurality of different times; and (e) in response to the controller, stitching, by the sewing head, the plurality of separate sections into the work piece based on the determined needle drop location. Next block 504 indicates the method further comprising pausing the stitching between completion of stitching at least one of the plurality of separate sections.

Following block 504, block 506 relates to wherein the embroidery design is an electronic embroidery design. Block 508 specifies wherein the sewing head comprises a reciprocating needle for stitching having a reciprocating cycle, and an encoder for regulating a location of the reciprocating needle in its reciprocating cycle. Finally, block 510 states the method further comprising displaying, by a display, the plurality of separate sections, and assigning a reference character to each one of the plurality of separate sections, wherein each reference character is an identifier for one of the plurality of separate sections. Embodiments provide that block 510 can be operably performed prior to the selecting step found in block 502.

The logic diagrams of FIG. 4 and FIG. 5 may be considered to illustrate the operation of a method, and a result of execution of computer program instructions stored in a computer-readable memory, and a specific manner in which components of an electronic device are configured to cause that electronic device to operate, whether such an electronic device is a quilting machine or some other device, or one or more components thereof. The various blocks shown in FIG. 4 and FIG. 5 may also be considered as plurality of coupled logic circuit elements constructed to carry out the associated function(s), or specific result of strings of computer program instructions or code stored in a memory.

Various elements of the computer-readable memory or computer-readable medium include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. Various embodiments of the processor include, but are not limited to general purpose computers, special purpose computers, microprocessors, digital signal processors and multi-core processors.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A method for stitching, the method comprising:

(a) examining, by an examiner, an embroidery design comprising computer program instructions for needle drop locations of stitches and movement instructions of a work piece relative to a sewing head, wherein the examiner is operably coupled to a controller and the sewing head, and wherein the controller comprises a memory having a capacity, and wherein the controller is operable to cause the sewing head to stitch a work piece;

(b) determining, by the examiner, a needle drop location of each stitch embroidery design and movement instructions of the sewing head relative to the work piece;

(c) dividing, by the examiner, the examined embroidery design into a plurality of separate sections;

(d) transmitting the plurality of separate sections at a plurality of different times to the controller based on the capacity such that the plurality of separate sections do not exceed the capacity of the memory at any one of the plurality of different times; and (e) in response to the controller, stitching, by the sewing head, the plurality of separate sections into the work piece based on the determined needle drop location.

2. The method according to claim 1, the method further comprising pausing the stitching between completion of stitching at least one of the plurality of separate sections.

3. The method according to claim 1, wherein the sewing head comprises a reciprocating needle for stitching having a reciprocating cycle, and an encoder for regulating a location of the reciprocating needle in its reciprocating cycle.

4. The method according to claim 1, the method further comprising displaying, by a display, the plurality of separate sections, and assigning a reference character to each one of the plurality of separate sections, wherein each reference character is an identifier for one of the plurality of separate sections.

5. An apparatus for stitching, the apparatus comprising:

an examiner operable to examine an embroidery design to determine a needle drop location of each stitch of the embroidery design and movement instructions of the sewing head relative to the work piece, the examiner is further operable to divide the examined embroidery design into a plurality of separate sections, the examiner operable to maintain the embroidery design and the plurality of separate sections in an examiner memory;

a sewing head including a reciprocating needle, the sewing head operable to stitch a work piece; and a controller having a memory capacity and operably coupled to the examiner and the sewing head, the controller operable to cause the sewing head to move relative to the work piece and to stitch the work piece, the controller operable to receive the plurality of separate sections from the examiner at a plurality of different times based on the capacity such that the plurality of separate sections do not exceed the memory capacity at any one of the plurality of different times, wherein the sewing head is operable to stitch, in response to the controller, the plurality of separate sections into the work piece based on the determined needle drop location, and wherein the embroidery design comprises computer program instructions for needle drop locations of stitches and movement instructions of a work piece relative to a sewing head.

6. The apparatus according to claim 5, wherein the controller is operable to cause the sewing head to pause the stitching between completion of stitching at least one of the plurality of separate sections.

7. The apparatus according to claim 5, the apparatus further comprising an encoder for regulating a position of the reciprocating needle within its reciprocating cycle.

8. The apparatus according to claim 5, the apparatus further comprising a display for displaying the plurality of separate sections, and assigning a reference character to each one of the plurality of separate sections, wherein each reference character is an identifier for one of the plurality of separate sections.

* * * * *